US005322464A

United States Patent [19]

Sanford

[11] Patent Number: 5,322,464

[45] Date of Patent: Jun. 21, 1994

[54] COMPOUND-BUBBLE PRODUCING FLYING TOY

[76] Inventor: Richard Sanford, R.D. 1, Box 24, Nineveh, N.Y. 13813

[21] Appl. No.: 28,939

[22] Filed: Mar. 5, 1993

Related U.S. Application Data

[63] Continuation of Ser. No. 801,270, Dec. 2, 1991, abandoned.

[51] Int. Cl.[5] ..... A63H 33/28; A63H 27/00

[52] U.S. Cl. ..... 446/15; 446/61

[58] Field of Search ..... 446/15, 16, 17, 18, 446/19, 20, 61, 63, 34

[56] References Cited

U.S. PATENT DOCUMENTS

| | | | |
|---|---|---|---|
| D. 168,724 | 2/1953 | Anderson | 446/61 X |
| D. 304,466 | 11/1989 | Brown | 446/15 X |
| 1,568,319 | 1/1926 | Cogswell | 446/61 |
| 3,909,976 | 10/1975 | Kirk | 446/61 |
| 3,950,887 | 4/1976 | Kort | 446/15 |
| 4,775,348 | 10/1988 | Collins | 446/16 |
| 5,041,042 | 8/1991 | Stein | 446/15 |
| 5,071,382 | 12/1991 | Sanford | 446/15 |
| 5,078,636 | 1/1992 | Clarke et al. | 446/15 |
| 5,156,564 | 10/1992 | Hasegawa | 446/20 X |

FOREIGN PATENT DOCUMENTS

| | | | |
|---|---|---|---|
| 2316497 | 4/1974 | Fed. Rep. of Germany | 446/15 |
| 959619 | 6/1964 | United Kingdom | 446/18 |
| 2224951 | 5/1990 | United Kingdom | 446/15 |

*Primary Examiner*—David N. Muir

*Attorney, Agent, or Firm*—Richard G. Stephens

[57] ABSTRACT

A thrown or flying toy includes a bubble-producing element having plural openings and capable of producing compound bubbles (plural bubbles attached to each other) which generally resemble the shape of a toy airplane or a cartoon-like character.

6 Claims, 2 Drawing Sheets

COMPOUND-BUBBLE PRODUCING FLYING TOY

CROSS REFERENCE TO RELATED APPLICATIONS

This application is a continuation of my prior copending U.S. application Ser. No. 07/801,270 filed Dec. 2, 1991.

FIELD OF THE INVENTION

This invention relates to bubble-producing flying or thrown toys, and in particular to a novel form of toy which provides a desirable class of shapes of bubbles. Various forms of flying or thrown bubble-producing toys are known, including types shown in my prior co-pending U.S. application Ser. No. 07/559,147 filed Jul. 27, 1990 now U.S. Pat. No. 5,071,382.

RELATED PRIOR ART

The following U.S. patents show some prior forms of flying or thrown bubble-producing toys which do not produce compound bubbles having a desired or predetermined configuration.

| | |
|---|---|
| 3,002,314 | Brottman |
| 3,008,263 | Ellman |
| 3,109,255 | Hein |
| 3,600,842 | Bryman |
| 4,184,284 | Rogahn |

SUMMARY OF THE INVENTION

A primary object of the present invention is to provide a toy which not only produces bubbles, but one which produces special-shaped or compound-types or combinations of bubbles. Many prior art devices are capable of producing essentially-spherical, or quite oblate unitary bubbles. It is believed that many children are much more attracted by a toy which can produce more complex bubbles, and provision of a toy which can do so is a primary object of the present invention.

As one example, it is believed that a toy which is very appealing to many children will produce not only a large central "body" bubble, but simultaneously therewith a pair of smaller "ear" bubbles which are attached to and issued together with the "body" bubble, providing a resultant three-bubble display. The invention was originally devised to provide bubble combinations generally simulating a "Mickey Mouse" character which has a rounded head portion with two large attached ears. ("Mickey Mouse" is believed to be a trademark of Disney Productions, Inc.). Whether or not the combinations of bubbles produced using the invention simulate a Disney character, it is believed that such bubble combinations are attractive to many small children. It will become apparent as the description proceeds that a wide variety of plural-bubble patterns or combinations may be produced.

Another object of the invention is to provide a novel toy which is extremely economical to produce.

Other objects of the invention will in part be obvious and will in part appear hereinafter.

The invention accordingly comprises the features of construction, combinations of elements, and arrangement of parts, which will be exemplified in the constructions hereinafter set forth, and the scope of the invention will be indicated in the claims.

BRIEF DESCRIPTION OF THE DRAWING

For a fuller understanding of the nature and objects of the invention reference should be had to the following detailed description taken in connection with the accompanying drawing(s), in which.

DESCRIPTION OF THE PREFERRED EMBODIMENT

Figure 2:
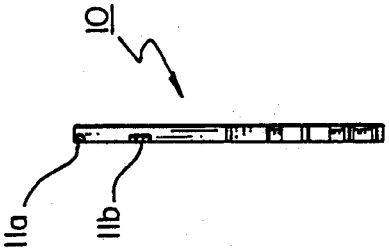
FIG. 2 is an end view taken at lines 2—2 in FIG. 1.
Figure 1:
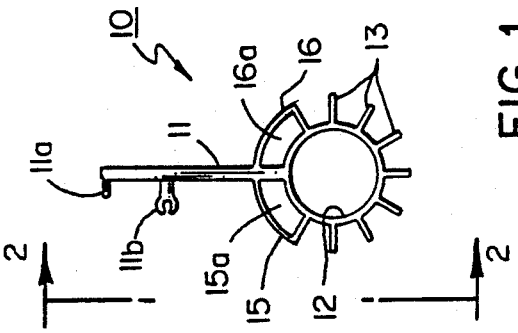
FIG. 1 is a side view of one form of bubble-producing element constructed according to the invention.
Figure 5:
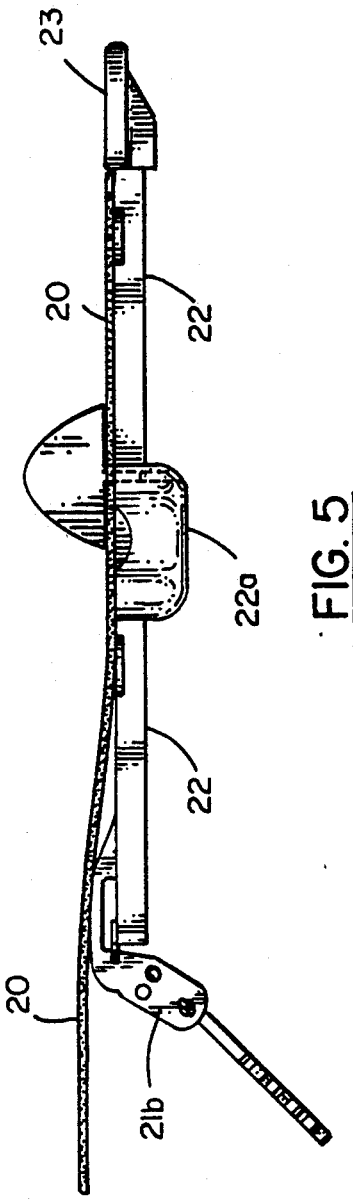
FIG. 5 is a side elevation view of the toy airplane showing the bubble-producing element attached to the tail of the toy airplane.

Referring to FIGS. 1 and 2, one form of bubble-producing element 10 is shown as comprising an integral member, preferably of injection-molded plastic, having an arm portion 11 and a circular ring portion 12 attached to one end of the arm portion. The arm portion 11 carries a pair of laterally-extending prongs **11*a*,11*b*, which may be pushed through a pair of holes to mount the bubble-producing element, as will be explained below. Prong 11*b* carries a slot, so that it may be pushed through a hole in a mounting tab, and then spread to removably lock that prong in place. Ring portion 12 is provided with a plurality of radially outwardly extending fingers 13,13 which increase the surface area of the ring. When the ring is immersed in a bubble solution the fingers increase the amount of solution which adheres to the device, thereby aiding the eventual formation of one or more sizeable bubbles. A central portion of ring 12 is open, and as air passes over the element, generally perpendicular to the plane of FIG. 1, one or more bubbles are formed, with each bubble having a diameter approximating the diameter of ring portion 12**.

Figure 3:
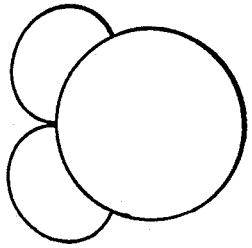
FIG. 3 is a diagram showing a compound bubble which may be produced by the bubble-producing element of FIGS. 1 and 2.
Figure 4:
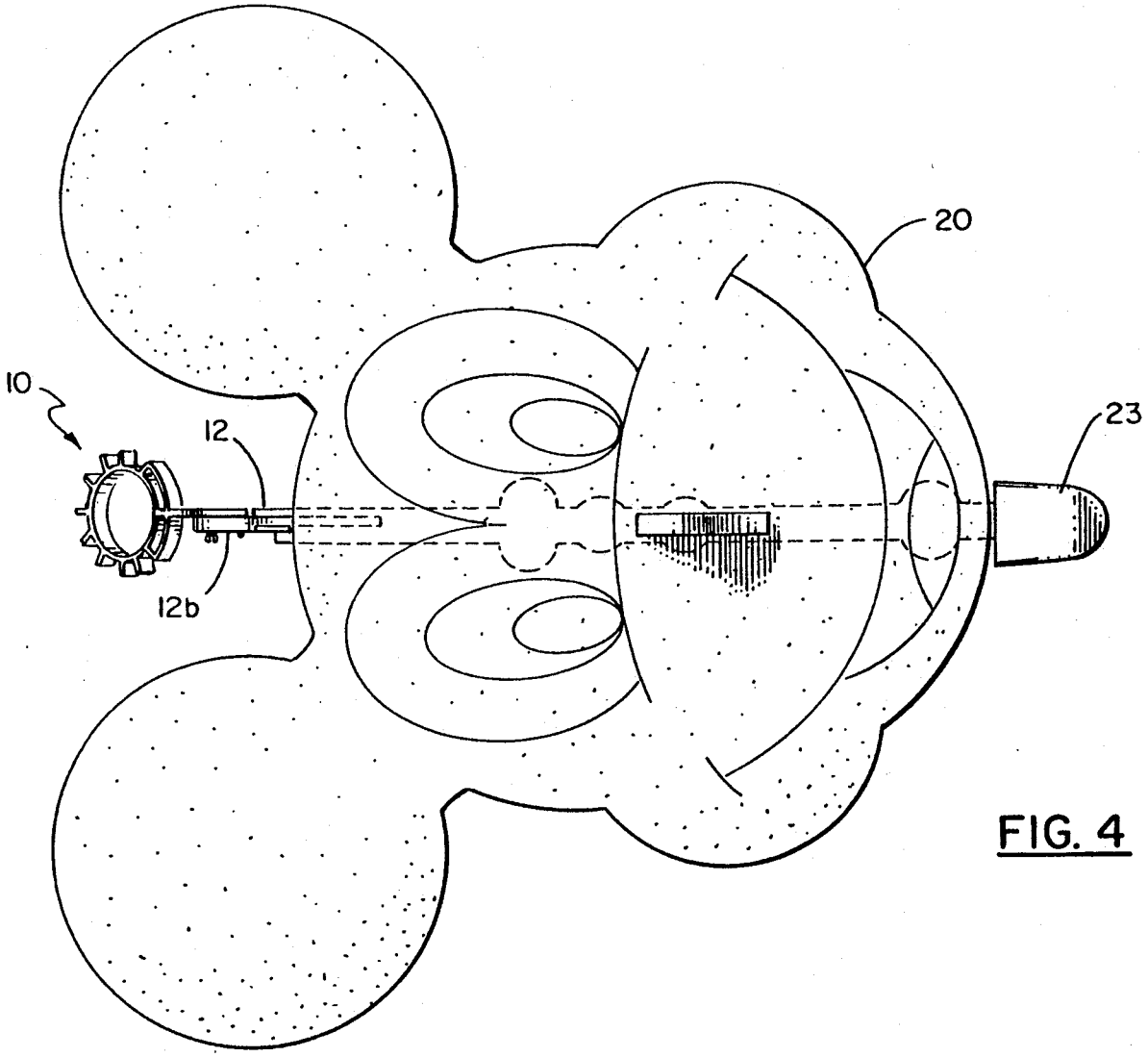
FIG. 4 is a top view of one form of toy airplane which may be used to carry the bubble-producing element.

Notably in FIG. 1, thin band portions 15,16 are provided spaced radially outwardly from ring portion 12, with the radial distances of the band portions being a fraction of the diameter of the ring portion. It also should be noted that the radial distance of the band portions from ring 12 approximates the angular distance around the ring at which fingers 13,13 are spaced. When the assembly is immersed in bubble solution, the solution also coats the spaces **15*a*,16*a* between the band portions 15,16 and ring 12, and when air is then suitably directed over the element, not only is a relatively large bubble produced by the ring, but a pair of smaller bubbles attached to the larger bubble, due to the close proximity of openings 15*a*,16*a* to the central opening of ring 12. The general nature of the compound bubble is illustrated in FIG. 3. It should be compared with the top view of the toy airplane shown in FIG. 4, and both will be seen as comprising a larger generally-circular portion having two smaller generally-circular portions. Having a toy airplane which produces a compound bubble which generally simulates a small version of the toy airplane itself is believed to be an outstanding feature of the invention. A toy which produces a compound bubble which simulates a familiar cartoon character is also believed to be very desirable. As shown in FIG. 4, the top or wing piece 20** of the toy airplane is decorated with indicia resembling the face of Mickey Mouse, or the face of some other cartoon character, which tends to insure that the user will associate the compound bubble with that cartoon character, even if the user is a very young child.

The top wing piece 20 is preferably cut from a thin (e.g., 15 mil) sheet of polystyrene foam or an equivalent light plastic, with a very simple stamping operation. The body 22 comprises a rigid plastic rod which is preferably injection molded. A soft rubber cap 23 friction-fitted on the front end of the rod both helps determine the longitudinal center-of-gravity, to provide stable aerodynamic characteristics, and acts as a bumper to avoid injury or damage if the toy strikes a person or other object. An enlarged pad portion 22*a* serves as a handle which a user can readily grasp between a thumb and forefinger in order to throw the toy airplane. The body 22 may include a plurality of laterally-projecting arms which support the wing piece near the center of the wing piece. A tab portion 21*b* includes a plurality of holes into a pair of which the prongs of the bubble-producing element may be fitted to hold that element at a desired angle relative to the longitudinal axis of the toy airplane. The idea of adjusting that angle is not new, and is shown in my above-mentioned U.S. Pat. No. 5,071,382. The wing piece 20 can be affixed to the body piece 22 in a variety of different ways, such as cementing. In the specific embodiment shown, a nose piece 25 having a pin-like lower projection is force-fitted into a hole in rod 22 to affix wing 20 to 22.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawing shall be interpreted as illustrative and not in a limiting sense.

The embodiments of the invention in which an exclusive property or privilege is claimed are defined as follows:

1. A bubble producing, flying toy comprising:

a) longitudinally elongated, substantially planar body having first and second ends, and handle means positioned therebeneath whereby said flying toy may be propelled to glide through air when thrown;

b) a tab portion integrally extending downwardly from said first end of said body, said tab portion including at least one aperture formed therethrough;

c) a bubble producing element having:

i) an elongated arm having first and second ends;

ii) a ring portion integrally extending from said elongated arm 1st end, said ring portion defining a substantially circular opening;

iii) at least one band portion integrally extending adjacent both said ring portion and said elongated arm, said band portion defining an open space positioned adjacent said circular opening, said band and said circular ring portion adapted to form a compound bubble having a predetermined, distinct shape, wherein said distinct shape includes at least two bubbles having portions of their external surfaces joined to one another; and iv) at least one prong extending laterally outward from said arm adjacent said second end of said arm, said at least one prong being adapted to releasably engage said at least one aperture thereby removably connecting said bubble producing element to said flying toy; and d) said substantially planar surface having a planform substantially identical to said predetermined, distinct shape produced when said flying toy glides through air.

2. The invention according to claim 1 wherein said bubble producing element is pivotally movable with respect to said body portion.

3. The invention according to claim 1 wherein said bubble producing element includes first and second band portions defining respective open spaces, said first and second band portions and said ring portion cooperatively adapted to form a first substantially spherical bubble having a first radius and second and third bubbles having substantially identical second radii wherein said second radius is a fraction of said first radius and said first second and third bubbles are externally joined to one another.

4. The invention according to claim 1 wherein said ring bears an insignia having a substantially identical shape as said planform, said insignia extending substantially over said planform.

5. The invention according to claim 1 wherein said ring represents the face of a cartoon character.

6. The invention according to claim 1 wherein said ring portion includes a plurality of fingers extending radially outward therefrom aiding in bubble solution retention during flight of said toy.

* * * * *